US008308095B2

(12) United States Patent
Solomon et al.

(10) Patent No.: US 8,308,095 B2
(45) Date of Patent: Nov. 13, 2012

(54) CRUSHER CLEARING SYSTEM

(75) Inventors: Mark Solomon, Orefield, PA (US); Walter D. Repinski, New Berlin, WA (US); Andrew Charles Fried, Slatington, PA (US); K. Chris Littleford, Scotrun, PA (US)

(73) Assignee: Flsmidth A/S (DK)

( * ) Notice: Subject to any disclaimer, the term of this patent is extended or adjusted under 35 U.S.C. 154(b) by 45 days.

(21) Appl. No.: 13/013,304

(22) Filed: Jan. 25, 2011

(65) Prior Publication Data

US 2012/0187224 A1 Jul. 26, 2012

(51) Int. Cl.
*B02C 2/00* (2006.01)

(52) U.S. Cl. ..... 241/207

(58) Field of Classification Search ..... 241/207–218, 241/166

See application file for complete search history.

(56) References Cited

U.S. PATENT DOCUMENTS

| | | | | |
|---|---|---|---|---|
| 2,791,383 | A | 5/1957 | Kjelgaard | |
| 3,059,622 | A | 10/1962 | Sexauer | |
| 3,754,716 | A * | 8/1973 | Webster | 241/208 |
| 3,797,760 | A * | 3/1974 | Davis et al. | 241/30 |
| 4,025,985 | A | 5/1977 | Rousseau | |
| 4,261,583 | A | 4/1981 | de Vries, Jr. et al. | |
| 4,615,491 | A * | 10/1986 | Batch et al. | 241/37 |
| 4,717,084 | A | 1/1988 | Vendelin et al. | |
| 4,750,681 | A | 6/1988 | Sawant et al. | |
| 5,649,669 | A * | 7/1997 | Ambrose et al. | 241/207 |
| 5,870,813 | A | 2/1999 | Ambrose et al. | |
| 5,875,981 | A * | 3/1999 | Ganser et al. | 241/215 |
| 5,971,306 | A * | 10/1999 | Ganser et al. | 241/207 |
| 6,032,886 | A * | 3/2000 | Drinkwater et al. | 241/37 |
| 2005/0269436 | A1 | 12/2005 | Sawant et al. | |
| 2006/0086852 | A1 * | 4/2006 | Juhlin | 241/207 |
| 2006/0278745 | A1 * | 12/2006 | Juhlin | 241/101.2 |

FOREIGN PATENT DOCUMENTS

KR 1020090123184 12/2009

OTHER PUBLICATIONS

IPRP from IPEA/US (Feb. 22, 2012).
International Search Report (Apr. 25, 2011).

* cited by examiner

*Primary Examiner* — Faye Francis
(74) *Attorney, Agent, or Firm* — Jeffrey A. Sharp; Aaron M. Pile; Daniel DeJoseph

(57) ABSTRACT

A system 100 and method for clearing a crushing device 1 of tramp material is disclosed. The system comprises at least one dual-acting cylinder 70 which serves to both maintain a constant crushing force between a head 500 and bowl 400, and also provide a clearing stroke to facilitate passage of said tramp material. The body of the at least one dual-acting cylinder 70 is mounted securely to a main frame 300 in a self-centering, self-seating arrangement by cylinder mount 40. The piston rod 30 of the at least one dual-acting cylinder 70 is directly or indirectly mounted securely to an adjustment ring 200 in a self-centering, self-seating arrangement. The piston rod 30 comprises a first securing member 10 and a second securing member 20. A mounting portion 202 associated with the adjustment ring 200 is captured between the first 10 and second 20 securing members of the piston rod 30.

18 Claims, 6 Drawing Sheets

CRUSHER CLEARING SYSTEM

BACKGROUND OF THE INVENTION

This invention relates to comminuting devices and more particularly to systems and processes for clearing a crusher of tramp material.

A crusher is a machine designed to reduce larger materials such as large rocks into smaller rocks, gravel, sand, and/or dust. Crushers may be used to reduce the size or change the form of waste materials. Crushing involves transferring forces amplified by mechanical advantage through robust crushing surfaces which are generally parallel or tangent to each other. Entering material is held between the crushing surfaces, and sufficient forces are applied to bring the crushing surfaces together. Energy is delivered to the material being crushed so that its molecules separate (i.e., fracture), or change alignment in relation to each other (i.e., deform).

Gyratory crushers can be used for primary or secondary crushing and generally comprise a conical head moveable with respect to a corresponding concave in close proximity. The surfaces of the head and concave are typically lined with manganese steel liners. The head moves slightly in a small circular motion via an eccentric arrangement, but does not rotate, whereas the concave remains stationary. Entering material falls between the head and concave and resides there while it is progressively crushed until its pieces are small enough to escape through a predetermined gap between the head and concave. The crushing action is caused by progressive opening and closing of the predetermined gap between the head and the concave.

Cone crushers, such as the one illustrated in FIG. 1 operate similarly to gyratory crushers, however, they generally comprise less steepness in the crushing chamber and more of a parallel zone between crushing surfaces 404, 504. Cone crusher 1 breaks up incoming entrance feed material 602 by squeezing it between a bowl 400 having a bowl liner 402 and a wear resistant mantle 502 supported by a head 500 mounted over top of a main shaft 700. The head 500 comprises a head bore 507 which receives an eccentric 900 spinning around main shaft 700 by virtue of a drive shaft 800 and one or more transmission members 802, 902 (e.g., bevel gears). The eccentric 900 comprises a bore 907 which accepts main shaft 700. Main shaft 700 is received by a shaft receiving portion 307 in a main frame hub 310. As the eccentric 900 rotates about the shaft 700, it causes the head 500 and mantle 502 to gyrate with respect to the bowl 400 and bowl liner 402. An axis 509 of the head bore 507 is generally offset from the axis 709 of the main shaft 700 as shown. One or more bushings (not shown) may be placed between the eccentric 900 and the head bore 507 and/or between the main shaft 700 and the eccentric bore 907. As the larger entrance material 602 enters the top of the cone crusher 1, it becomes wedged and squeezed between the mantle 502 and the bowl liner 402. Large pieces of ore are broken once, and then fall to a lower position within the crusher 1 as they become smaller in size. The ore is subsequently broken and the process continues until the comminuted material 604 is small enough to fall through a narrow predetermined gap "G" between the bottoms of the mantle 502 and the bowl liner 402.

When a crusher gets overloaded, it can jam, seize momentarily, or stall completely, leaving a large amount of material in the crushing chamber and hopper feeding the crushing chamber from above. To remove tramp iron or jammed material, the crushing chamber must be cleared of material. Some cone and gyratory crushers comprise hydraulic tramp release systems which serve to provide overload protection and minimize damage to the crusher when tramp passes through the crushing chamber. Such tramp release systems generally comprise two sets of hydraulic cylinders, as shown and described in U.S. Pat. No. 4,750,681. A first set of cylinders is activated to separate an upper crushing member from a lower crushing member and open the crushing chamber. This is generally called a clearing stroke. Another second set of cylinders serves to pull the upper crushing member towards the lower crushing member to close the crushing chamber so that crushing can take place. Having two sets of hydraulic cylinders adds to the cost, complexity, and failure mode of conventional crushers.

Moreover, as shown and described in U.S. Pat. No. 4,750,681 prior cylinders have been either directly attached by their body to main frames without means for angle compensation and with no piston rod attachment to the adjustment ring, or alternatively, have only been attached to adjustment rings by the piston rod with the cylinder body unattached to the main frame. Such arrangements lead to premature wear or failure, especially under high loads, because they may become cocked or unseated under high loads.

OBJECTS OF THE INVENTION

It is, therefore, an object of the invention to provide an improved crushing system which reduces the number of parts by providing dual-acting cylinders configured for both maintaining a constant crushing force between a head and mantle, and also providing a clearing stroke to facilitate passage of tramp material.

It is another object of the invention to provide improved means for coupling cylinders and piston rods thereof to crusher components, wherein said means for coupling is configured to compensate for small angular displacements, misalignments, and/or side loads experienced by the cylinders during operation of the crusher.

Moreover, it is an object of the invention to provide a crusher clearing system wherein accumulators need not be placed in close proximity with or directly attached to the cylinders.

Additionally, it is an object of the invention to provide a crusher having an improved response time for tramp release.

These and other objects of the invention will be apparent from the drawings and description herein. Although every object of the invention is believed to be attained by at least one embodiment of the invention, there is not necessarily any one embodiment of the invention that achieves all of the objects of the invention.

SUMMARY OF THE INVENTION

A crusher comprises a first member such as an adjustment ring having a first mounting portion, a second member such as a main frame having a second mounting portion, a dual-acting cylinder having a body and a piston rod movably disposed in relation to said body, the body being securely mounted to the second mounting portion of the second member via a cylinder mount. The piston rod comprises first and second securing members, wherein the first mounting portion of the first member is captured between said first and second securing members to secure the piston rod thereto. The dual-acting cylinder provides both: a crushing force between said first member and said second member, and a clearing force between said first member and said second member. In some embodiments, the first member may comprise an alignment ring, a bowl, or a bowl liner. The first and second securing members may be integral and monolithic with said piston rod, or may be separately joined, non-integral portion of said piston rod. The piston rod may comprise at least one mount for supporting the first and second securing members. In some embodiments, the first securing member, second securing member, and/or cylinder mount may comprise one or more centering washers, centering cups, centering portions, centering bearing surfaces, or centering features. In some instances tapered, conical, or spherical surfaces may be provided to the first and second securing members. The dual-acting cylinder may comprise a relief valve, a first crossover port extending from a first chamber, a second crossover port extending from a second chamber, and a crossover tube extending between the first crossover port and the second crossover port which connects the first chamber and the second chamber together. In some embodiments, the second securing member may comprise a seal and the first securing member may comprise a piston rod nut. The second securing member may comprise an annular collar which may be provided in separate connectable pieces, a single piece connectable to the piston rod, or integral with the piston rod.

A crusher clearing system adapted for providing crushing forces to components of a crusher and providing clearing forces to components of the crusher to facilitate the removal of tramp material from the crusher is also provided. The crusher clearing system comprises a dual-acting cylinder having a body and a piston rod movably disposed in relation to said body. The piston rod may comprise a first securing member adjacent a distal end portion of the piston rod and a second securing member adjacent a middle portion of the piston rod, wherein the first and second securing members are configured to capture a mounting portion of an adjustment ring therebetween. The body of the cylinder may be configured to be securely mounted to a mounting portion of a main frame with a cylinder mount.

A method of clearing a crusher upon overload is also provided. The method includes the step of providing a crusher comprising a first member having a first mounting portion, a second member having a second mounting portion, a dual-acting cylinder having a body and a piston rod movably disposed in relation to said body, the body being securely mounted to the second mounting portion of the second member via a cylinder mount. The piston rod comprises first and second securing members which capture the first member and secure the piston rod thereto. The method further comprises the step of filling a first chamber of the dual-acting cylinder to provide a crushing force between said first member and said second member. The method further comprises the step of filling a second chamber of the dual-acting cylinder to provide a clearing force between said first member and said second member. In some embodiments, the method may comprise the step of passing a fluid directly from the first chamber to the second chamber via a crossover tube extending between a first crossover port communicating with the first chamber and a second crossover port communicating with the second chamber. In other embodiments, the method comprises the step of passing a fluid through a relief valve separating the first and second chambers.

DETAILED DESCRIPTION OF THE INVENTION

Figure 1:
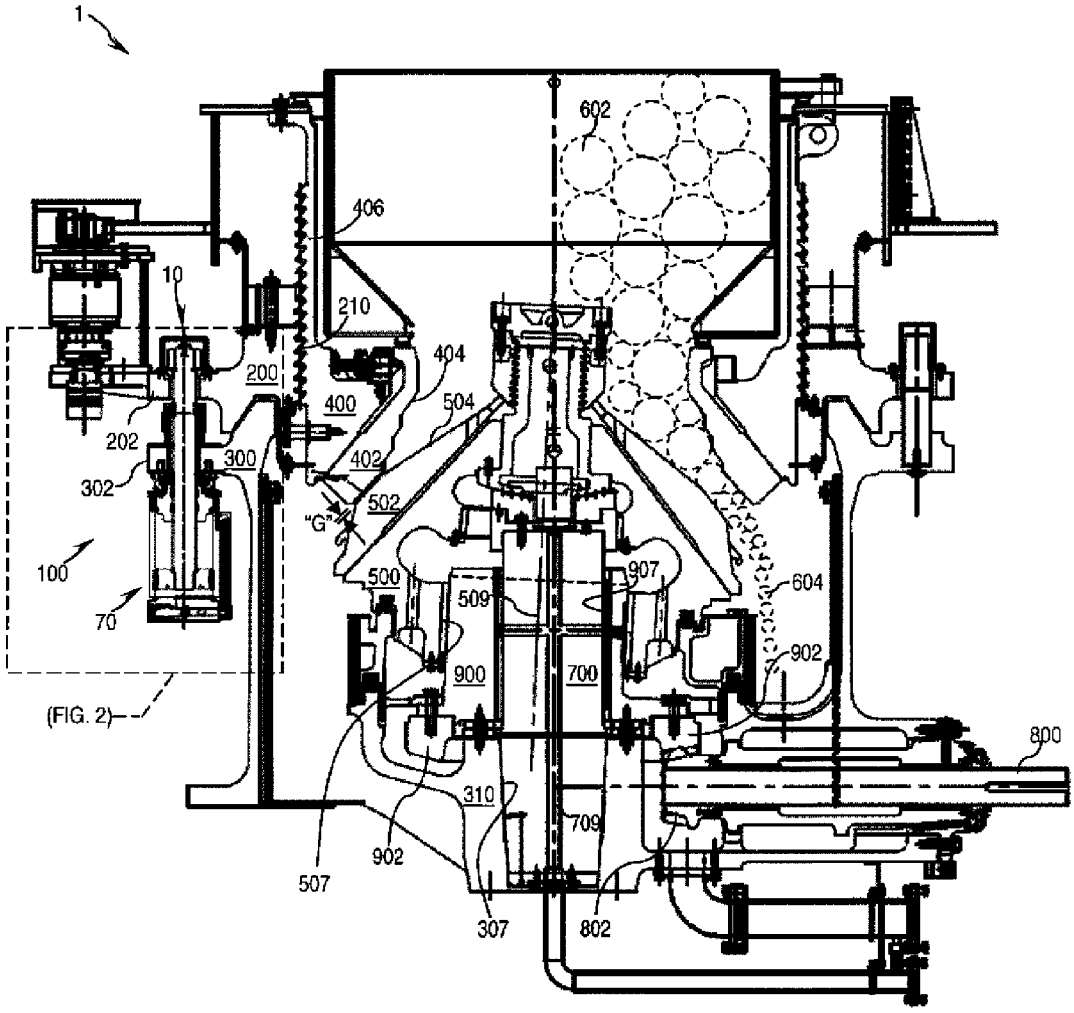
FIG. 1 shows a cross-section of a crusher having a crusher clearing system according to some embodiments.
Figure 2:
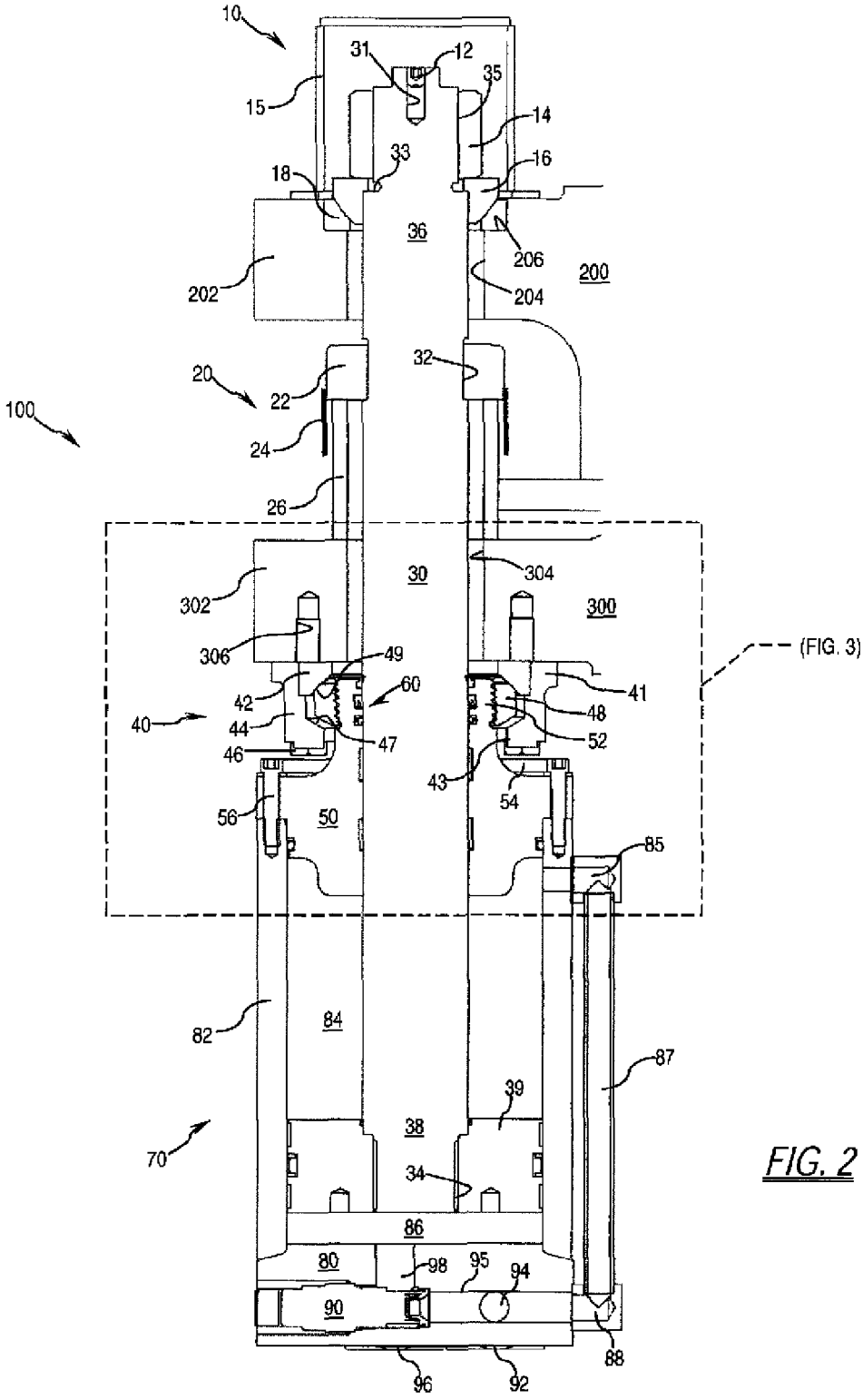
FIG. 2 is a detailed cross-sectional view of the crusher clearing system shown in FIG. 1.
Figure 3:
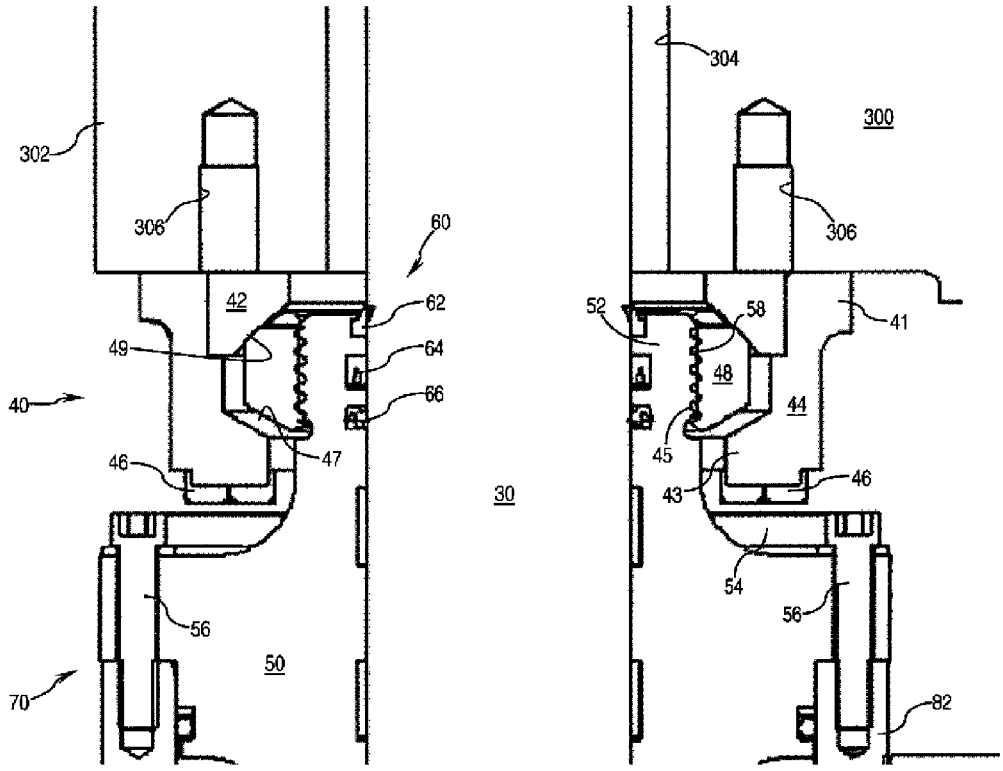
FIG. 3 is a detailed cross-sectional view of a cylinder mount shown in FIG. 2.

As shown in FIGS. 1-3, a crusher 1 and or a comminuting process for the recovery of a mineral or metal from ore may comprise, in accordance with some embodiments of the invention, a clearing system 100 operatively connected between a main frame 300 and any one or more of an adjustment ring 200, bowl 400, or bowl liner 402. The system 100 may comprise one or more dual-acting cylinders 70 (i.e., having both push and pull functionality) attached in non-pivoting arrangement to a mounting portion 302 of a main frame 300 via a cylinder mount 40. Piston rods 30 extending from each cylinder 70 extend through openings 304 in the mounting portion 302.

Each cylinder mount 40 may comprise a support 44 disposed around the piston rod 30 having a mounting flange 41 and a lower supporting lip 43 extending radially-inwardly towards the piston rod 30. The support 44 may be wedged, welded, adhered, threaded to, or otherwise bolted to the mounting portion 302 of the main frame 300 with one or more fasteners 46. Fasteners 46 may extend through openings in the support 44 as shown, or alternatively, may be integrally provided to the support (e.g., in the form of a protruding dovetail, a threaded collar extending around the perimeter of the support 44, or an aperture or track portion which accepts a protrusion or boss extending from the mounting portion 302). The fasteners 46 are received by one or more corresponding receiving portions 306 located on the mounting portion 302 of main frame 300. Receiving portions 306 may comprise threaded apertures as shown, but may also comprise grooves, tracks, protrusions, slots, keyways, or recesses which correspond to fasteners 46.

Lip 43 may comprise one or more self-centering and/or self-seating lower bearing surfaces 47. For example, a lower bearing surface 47 may comprise a tapered, conical, or spherical centering geometry as shown. A centering washer or cup 42 may be disposed within the support 44, the centering cup 42 providing a self-centering and/or self-seating upper bearing surface 49 adjacent the mounting portion 302 of the main frame 300. A centering bushing 48 may also be provided within the support 44 which contacts bearing surfaces 47 and 49. The centering bushing 48 may have upper and lower bearing surfaces which are complimentary to bearing surfaces 47 and 49 of the lip and centering cup 42, respectively. For example, the centering bushing 48 may have upper and/or lower bearing surfaces which are also conical or spherical as shown. In some embodiments, the centering bushing 48 may be an integral portion of a dual-acting cylinder 70, but may also be separately provided to the cylinder 70 as shown. In the event of the latter, the centering bushing 48 may comprise a female thread 45 which corresponds to a male thread 58 on a boss 52 extending from a cap 50 provided on an end of the cylinder 70. In such embodiments the cylinder 70 may be easily removed for maintenance and replaced by rotating the cylinder body 82 until threaded boss 52 becomes de-coupled with centering bushing 48.

Dual-acting cylinder 70 may comprise a body having cylinder wall 82, a piston rod 30 connected (e.g., by threaded interface 34) to a piston 39 located within the cylinder 70 at its proximal end 38, a first upper chamber 84 defined between a first end plate 54 and the piston 39 which, when expanded, moves the piston rod 30 toward the cylinder 70, and a second lower chamber 86 defined between the piston 39 and a second end plate 80 of the cylinder which is opposite the first end plate 54 and cap 50. A crossover tube 87 connects the first upper chamber 84 with the second lower chamber 86 via first upper crossover port 85 and second lower crossover port 88, respectively. Crossover tube 87 serves as a "fail safe" hydraulic protection system, which, in the event of an accumulator bladder or line failure or other hydraulic system failure, will still allow the bowl 400 and liner 402 to move away from the mantle 500 and main frame 300, thereby allowing tramp material to pass through the crusher 1 without mechanical overload.

First end plate 54 may serve to secure cap 50 to the cylinder wall 82 and seal off the first upper chamber 84, and it may be secured to the cylinder wall 82 via one or more fasteners 56. A seal 60 comprising one or more o-rings 62, 64, 66 disposed in annular circumferential groves between the piston rod 30 and the cap 50 may be provided. The grooves which support and contain the o-rings 62, 64, 66 may be provided in the piston rod 30, in the cap 50, or combinations thereof. A relief valve 90 may be provided on or within the second end plate 80 to allow fluid to quickly pressurize the second lower chamber 86 of cylinder 70. Accordingly, the crushing chamber defined between bowl liner 402 and mantle 502 may be cleared quickly to allow passage of tramp material. Relief valve 90 may be secured to the cylinder by insertion into the second end plate 80 by press fit or screw threads.

Provided to the piston rod 30 is a first securing member 10 and a second securing member 20 which captures or otherwise "sandwiches" a mounting portion 202 of the adjustment ring 200. The piston rod 30 passes through an opening 204 (e.g., an aperture) in the mounting portion 202. The second securing member 20 generally extends radially-outwardly from the piston rod 30 between the mounting portions 302, 202 of the main frame 300 and the adjustment ring 200, respectively. The first securing member 10 generally extends radially-outwardly from the piston rod 30 above the mounting portion 202 of the adjustment ring 200 on a side opposite the second securing member 20. The first securing member 10 may rest within a receiving portion 206 of the mounting portion 202, which may be, for example, a counterbore in the opening 204. While not shown, the second securing member 20 may similarly be accepted within a receiving portion provided within the mounting portion 202.

In some embodiments, the first securing member 10 may comprise a lower centering cup 18 having a tapered, conical, or spherical bearing surface, said centering cup 18 being received by the mounting portion 202, an upper centering bushing or washer 16 having a complimentary tapered, conical, or spherical bearing surface which abuts the bearing surface of the centering cup 18. The first securing member 10 may further comprise a piston rod nut 14 which is secured to a thread 35 provided on a distal end 36 of the piston rod 30. The piston rod nut 14 may contact the centering washer 16 until the washer 16 is flush with a first securing member mount 33, which may comprise a step, flange, groove, or keyway. One or more locking members (not shown) such as set screws, locknuts, or deformable washers may be provided to the first securing member 10 to lock the piston rod nut 14 to the piston rod 30 and/or prevent relative rotation therebetween. In some non-limiting embodiments, a plug member 12 such as a set screw may be provided to the distal end 36 of the piston rod 30 as shown. The plug member 12 may be inserted into a recess 31 axially disposed within a distal end 36 of piston rod 30. The plug member 12 may be threadedly advanced within recess 31 or otherwise "cap" the recess 31 in order to protect threads or other removal features located within the recess 31. Recess 31 may aid in the installation and/or removal of the dual-acting cylinder 70. For example, to install cylinder 70, a lifting member provided above the crusher 1 and having threads corresponding to those within recess 31 may be passed through openings 204, 304 and threadedly engage recess 31 to secure the lifting member to the piston rod 30. The lifting member may then be raised to hoist the piston rod 30 through openings 204, 304 until the cylinder 70 can be mounted to the mounting portion 300 via cylinder mount 40. A lifting member may be used in a similar fashion to lower the cylinder 70 for replacement or refurbishing.

A shield 15 may be provided to cover various portions of the first securing member 10 and prevent the ingress of dirt and dust between components. The shield 15 may be secured to the mounting portion 202 of the adjustment ring 200 by any means including welding, tacking, screwing, pressing, adhesives, or one or more fasteners or connectors 17 such as the screws shown in FIG. 4.

Figure 4:
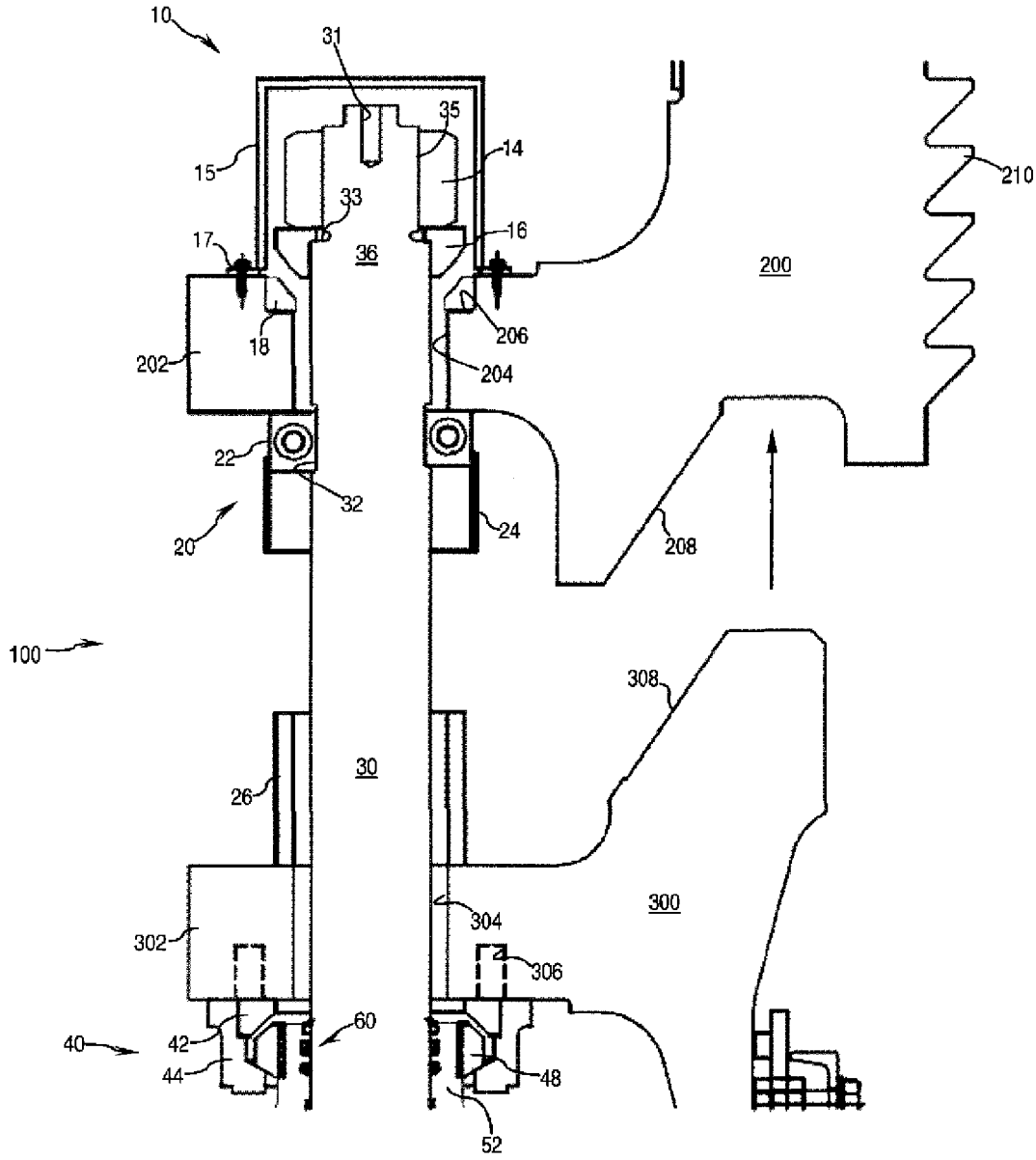
FIG. 4 depicts a crusher clearing system as shown in FIGS. 1-3 in operation during a clearing stroke.
Figure 5:
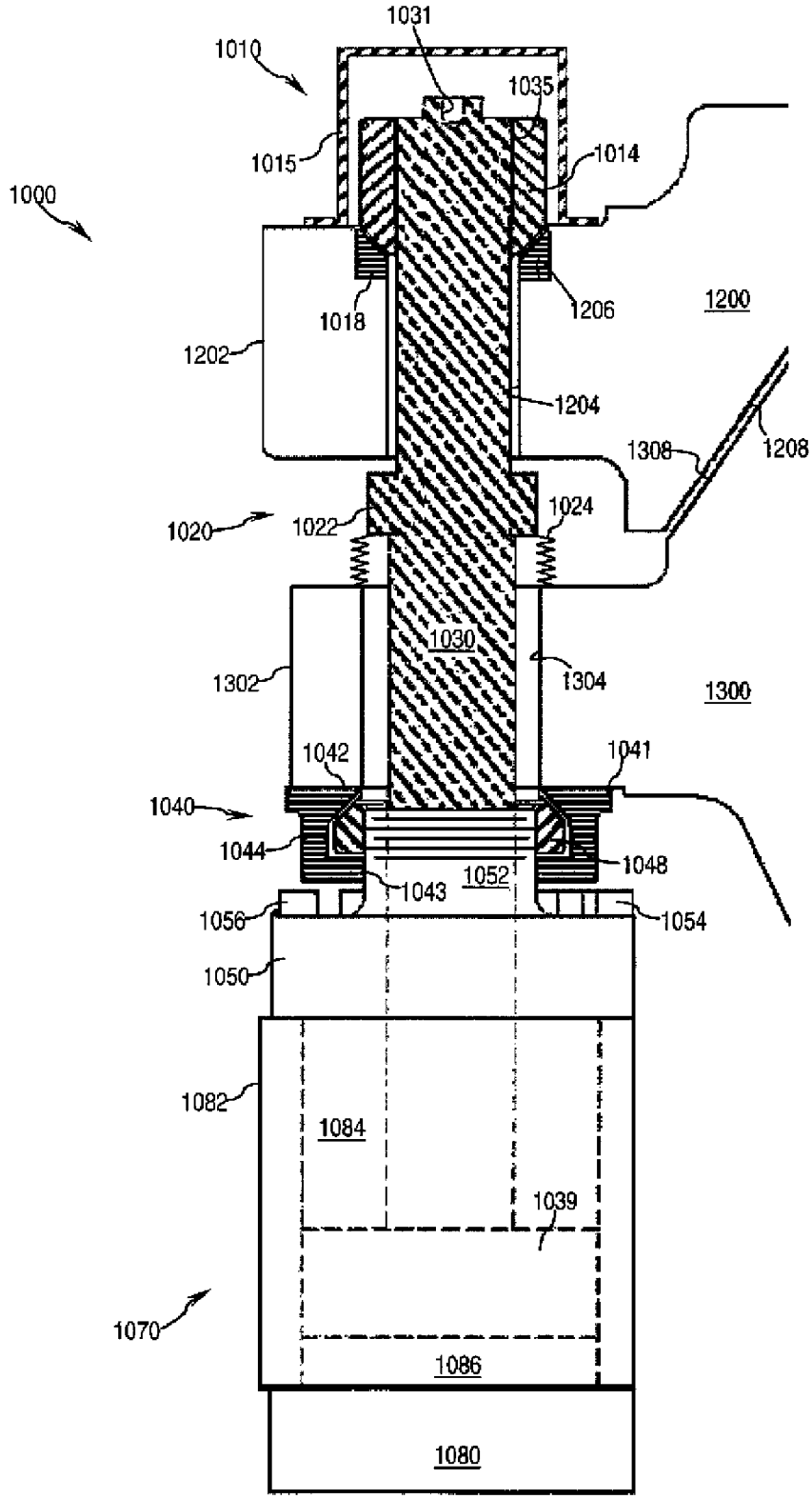
FIG. 5 is a detailed cross-sectional view of a crusher clearing system according to other embodiments; and, FIG. 6 depicts an alternative piston rod arrangement.
Figure 6:
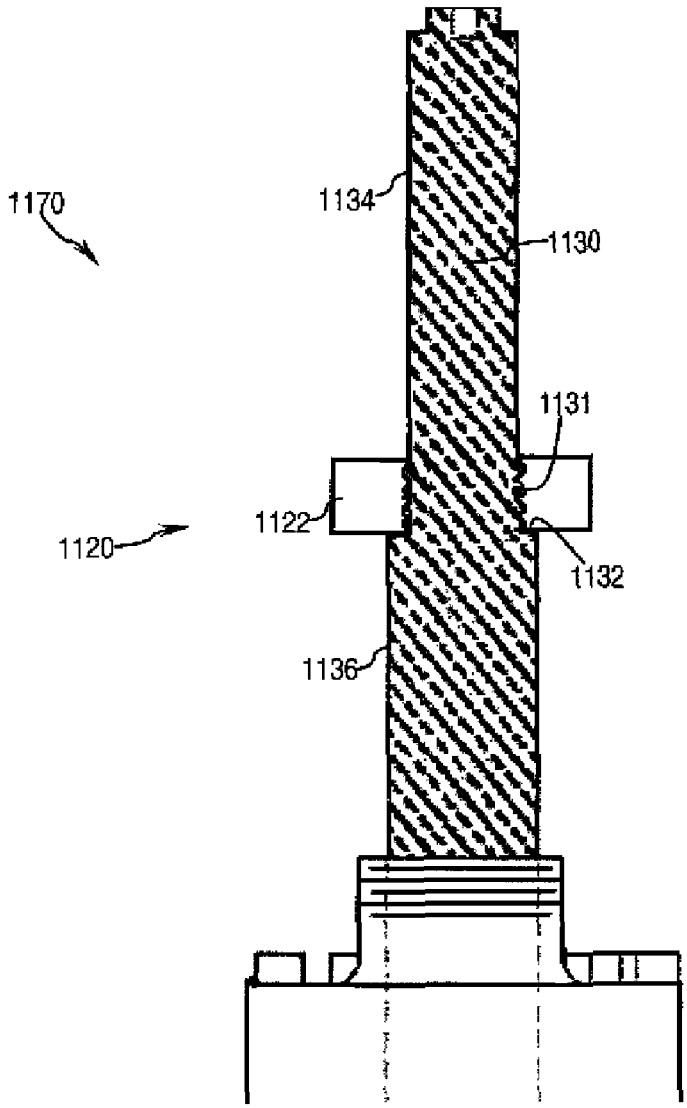

In some embodiments, the second securing member 20 may comprise a collar 22, an outer seal 24, and an inner seal 26 to prevent ingress of dirt and dust between piston rod 30 and cylinder cap 50. Inner 26 and outer 24 seals may be connected to be single seal 1024 as shown in FIG. 5 or may be separable during a clearing stroke as shown in FIG. 4. Collar 22 may be provided as a two-piece clamshell ring secured within a collar mount 32. Collar mount 32 may comprise a reduced diameter circumferentially-extending groove as shown in FIGS. 1-3. Alternatively, a dual-acting cylinder 1170 may comprise a second securing member 1120 having a collar mount 1132 which includes a gradual or step change in diameter of the piston rod 1130 between a smaller diameter distal section 1134 and a larger diameter proximal section 1136 as shown in FIG. 6. In such embodiments, the collar 1122 may be configured to slide freely over the distal section 1134 and stop at the collar mount 1132. One or more male threads 1131 may be provided to the piston rod 1130 adjacent the mount 1132 as shown, and the collar may be provided with one or more complimentary female threads, so as to prevent relative movement between the piston rod 1130 and collar 1122 during operation, particularly during and shortly after clearing strokes. Threads 1131 may also enable fine adjustment of the distance between first 1010 and second 1020 securing members or may allow the collar 1122 to be tightened against the mounting portion 1202 of the adjustment ring 1200. Even more alternatively, as shown in FIG. 5, a second securing member 1020 may comprise a collar 1022 which is integral with the piston rod 1030 and provided as a single unitary piece.

In operation, under normal crushing load conditions, hydraulic fluid such as oil is pumped through a first port 92 of the dual-acting cylinder 70, into a transfer tube 95 at T-junction 94, then past a second lower crossover port 88, subsequently through crossover tube 87, and then through the first upper crossover port 85, and finally into the first upper chamber 84. Accordingly, the first upper chamber 84 expands, pushing the piston 39 and the piston rod 30 attached thereto down towards the second end plate 80. As the piston rod 30 moves downwardly, it pulls the adjustment ring 200, bowl 400, and bowl liner 402 down towards the mantle 402 (by virtue of the first securing member 10) until the first mating surface 208 of the adjustment ring 200 contacts the second mating surface 308 of the main frame 300. Gap "G" (representing a "close size setting" for the crusher 1) generally determines the average size of the comminuted material 604, and may be adjusted by moving bowl 400 along adjusting surfaces 210, 406.

As shown in FIG. 4, during operation, if at any point in time the crusher 1 seizes due to non-crushable tramp material entering the crusher 1 or jamming in the gap "G" between the bowl liner 402 and mantle 502, fluid from an accumulator (not shown) may be pumped into the second port 96, past relief valve 90, through second lower chamber feed channel 98, and then into the second lower chamber 86 to provide a clearing stroke to piston 39, which moves (by virtue of the piston rod 30) the adjustment ring 200, bowl 400, and bowl liner 402 far enough away from the mantle 502 to allow tramp material to pass therebetween. During the clearing stroke, collar 22 contacts, supports, and urges the mounting portion 202 of the adjustment ring 200 upward. In turn, the bowl 400 and bowl liner 402 are moved upward to widen the predetermined gap "G" between bowl liner 402 and mantle 502. Though not shown, contact between the mounting portion 202 and collar 22 may improved by providing a self-centering/self-seating frustoconical, tapered, or spherical upper surface to the collar 22 which is configured to mate with a corresponding frustoconical, tapered, or spherical lower surface on mounting portion 202 (e.g., provided on a tapered counterbore within opening 204).

In addition to or in lieu of the above, if tramp material enters into the crusher 1 between the mantle 502 and bowl liner 402, an inherent increase in reaction forces between the bowl 400 and head 500 is experienced and pressure builds in the first upper chamber until it exceeds a predetermined blow off pressure regulated by relief valve 90. Accordingly, hydraulic fluid automatically flows from the first upper chamber 84, through the first upper crossover port 85, subsequently through crossover tube 87, and then past the second lower crossover port 88, along transfer tube 95, through relief valve 90, out the second lower chamber feed channel 98, and finally into the second lower chamber 86. As fluid enters the second lower chamber 86, the piston 39 moves piston rod 30 upwards until collar 22 contacts a lower surface of the mounting portion 202, thereby pushing the adjustment ring 200, bowl 400, and bowl liner 402 upwards away from the mantle 502. As the bowl liner 402 moves away from the mantle 502, tramp is allowed to pass through the crusher 1 without mechanical overload.

FIG. 5 illustrates a clearing system 1000 according to other embodiments. The clearing system 1000 may comprise one or more dual-acting cylinders 1070 (i.e., having both push and pull functionality) attached to a mounting portion 1302 of a main frame 1300 via a cylinder mount 1040. Piston rods 1030 extending from pistons 1039 in cylinders 1070 extend through openings 1304 in the mounting portion 1302. The body of each cylinder 1070 is generally constrained in all degrees of freedom with respect to mounting portion 1302 by support 1044. However, in some instances, cylinder 1070 may have a freedom of rotation about a longitudinal axis of the piston rod 1030. Support 1044 prevents the cylinder 1070 from falling downwards away from the mounting portion 1302 of the main frame 1300 which is common with conventional tramp clearing systems.

Each cylinder mount 1040 may comprise a support 1044 disposed around the piston rod 1030 having a mounting flange 1041 and a lower supporting lip 1043 extending radially-inwardly towards the piston rod 1030. The support 1044 may be wedged, welded, adhered, threaded to, pressed, swaged, captured within, or otherwise bolted to the mounting portion 1302 of the main frame 1300 with one or more fasteners. Fasteners may extend through openings in the support 1044, or may be integrally provided to the support 1044 (e.g., in the form of a protruding dovetail, a threaded collar extending around the perimeter of the support 1044, or a hole configured to receive a protrusion from mounting portion 1302). If used, fasteners may communicate with one or more corresponding receiving portions located within mounting portion 1302. Receiving portions (not shown) may comprise threaded apertures, but may also comprise grooves, tracks, protrusions, or recesses which correspond to fasteners.

To improve self-seating and re-seating of the cylinder 1070 during a clearing stroke and to prevent excessive bending moments to piston rod 1030, lip 1043 may comprise one or more bearing surfaces or features (e.g., conical, spherical, or tapered centering geometries), but may be generally planar as shown, in order to allow the cylinder 1070 small amounts of sideways movement. Likewise, a centering portion 1042 may also be integrally provided to an upper portion of the support 1044 adjacent the mounting portion 1302 of the main frame 1300 to assist with self-seating and re-seating of the cylinder 1070 after a clearing stroke and during normal crushing operation. A centering bushing 1048 may also be provided within the support 1044 which contacts bearing surfaces on the lip 1043 and/or centering portion 1042. The centering bushing 1048 may have upper and lower bearing surfaces which are complimentary to bearing surfaces on the lip 1043 and centering portion 1042. The support 1044 may be provided in clamshell form so as to be assembled by combining radially-partitioned halves or quarters of the support 1044 around the centering bushing 1048 to capture the centering bushing 1048 therein. By bifurcating the support 1044 in at least two sections, the centering bushing 1048 may be captured and restrained from movement. Centering portion 1042 may serve a similar purpose as the centering cup 42 in the embodiment shown in FIGS. 1-4. In some embodiments, the centering bushing 1048 may be an integral portion of a dual-acting cylinder 1070, an integral portion of support 1044, or may be separately provided to the cylinder 1070 as shown. In the event of the latter, the centering bushing 1048 may comprise a female thread which corresponds to a male thread on a boss 1052 extending from a cap 1050 provided on an end of the cylinder 1070. In such embodiments the cylinder 1070 may be easily removed for maintenance and replaced by rotating the cylinder body 1082 until threaded boss 1052 becomes de-coupled with centering bushing 1048. To facilitate removal of the cylinder 1070, one or more anti-rotation features may be provided between support 1044 and bushing 1048.

Dual-acting cylinder 1070 may comprise a body having cylinder wall 1082, a piston rod 1030 connected to a piston 1039 located within the cylinder 1070 at a proximal end of the piston rod, a first upper chamber 1084 defined between a first end plate 1054 and the piston 1039 which, when expanded, moves the piston rod 1030 toward the cylinder 1070, and a second lower chamber 1086 defined between the piston and a second end plate 1080 of the cylinder 1070 which is opposite the first end plate 1054 and cap 1050. First end plate 1054 may be secured to the cylinder wall 1082 via one or more fasteners 1056, and may serve to secure cap 1050 to the cylinder wall 1082 and/or seal off the first upper chamber 1084.

Provided to the piston rod 1030 is a first securing member 1010 and a second securing member 1020 which capture or collectively "sandwich" a mounting portion 1202 of the adjustment ring 1200. The piston rod 1030 passes through an opening 1204 (e.g., an aperture or slot) in the mounting portion 1202. The second securing member 1020 generally extends radially-outwardly from the piston rod 1030 between the mounting portions 1302, 1202 of the main frame 1300 and the adjustment ring 1200, respectively. The first securing member 1010 generally extends radially-outwardly from the piston rod 1030 above the mounting portion 1202 of the adjustment ring 1200 on a side opposite the second securing member 1020. The first securing member 1010 may rest within a receiving portion 1206 of the mounting portion 1202, which may be a counterbore in the opening 1204. While not shown, the second securing member 1020 may also be accepted within a receiving portion (e.g., counterbore) provided within the mounting portion 1202.

In some non-limiting embodiments, the first securing member 1010 may comprise a lower centering cup 1018 having an upper tapered, conical, or spherical bearing surface, said centering cup 1018 being received by the mounting portion 1202. First securing member 1010 may further comprise a piston rod nut 1014 having a complimentary tapered, conical, or spherical lower bearing surface which is received by the upper bearing surface of the centering cup 1018. While not shown, one of ordinary skill in the art would appreciate that a bottom portion of the piston rod nut 1014 may instead be concave, and the upper portion of centering cup 1018 may instead be convex. Centering cup 1018 may be loosely-seated, soldered, adhered, welded, or pressed within a receiving portion 1206 located in the mounting portion 1202. The piston rod nut 1014 may be secured to a thread 1035 provided at a distal end of the piston rod 1030. The piston rod nut 1014 may contact the centering cup 1018 until flush with the centering cup 1018. While not shown, nut 1014 may rest directly within receiving portion 1206 without the use of centering cup 1018. A locking member may be provided to lock the piston rod nut 1014 to the piston rod 1030. Locking members may include locknuts, castellated nuts, wire, clevis pins, detents, cotter pins, cotter rings, deformable washers, deformable threads, and swage ferrules, without limitation. In some embodiments, a recess 1031 may be axially disposed within the distal end of piston rod 1030 in order to aid in the installation and/or removal of the dual-acting cylinder 1070 by a lifting member such as a hoist.

A shield 1015 may be provided to cover various portions of the first securing member 1010 and prevent the ingress of dirt and dust between components 1014, 1018, 1206. The shield 1015 may be secured to the mounting portion 1202 of the adjustment ring 1200 by any means including, but not limited to: welding, tacking, screwing, pressing, adhesives, connectors, or fasteners as shown in FIG. 4.

In some non-limiting embodiments, the second securing member 1020 comprises a radially-outwardly extending collar 1022 which is integral with the piston rod 1030, and a seal 1024 to prevent ingress of dirt and dust between the piston rod 1030 and cylinder cap 1050. However, collar 1022 may instead be provided as a two-piece clamshell ring as shown in FIGS. 1-3. Collar 1022 may also comprise an annular shoulder or a gradual or step change in diameter of the piston rod 1030 between a smaller diameter distal section and a larger diameter proximal section, without the use of a separate flange. Though not shown, in some instances, collar 1022 may comprise a self-centering and/or self-seating frustoconical, tapered, or spherical upper surface which mates with a corresponding frustoconical, tapered, or spherical lower surface provided on mounting portion 1202 (e.g., a tapered counterbore within opening 1204).

As the piston rod 1030 moves downwardly, it pulls the adjustment ring 1200 downward towards the main body 1300 (by virtue of the first securing member 1010) until the first mating surface 1208 of the adjustment ring 1200 contacts the second mating surface 1308 of the main frame 1300.

A contractor or other entity may provide a crusher clearing system 100, 1000 or process for passage of material in part or in whole as shown and described. For instance, the contractor may receive a bid request for a project related to designing a crusher clearing system 100, 1000 or process, or the contractor may offer to design such a system 100, 1000 or a process for a client. The contractor may then provide, for example, any one or more of the devices or features thereof shown and/or described in the embodiments discussed above. The contractor may provide such devices by selling those devices or by offering to sell those devices. The contractor may provide various embodiments that are sized, shaped, and/or otherwise configured to meet the design criteria of a particular client or customer or work advantageously with a particular crusher. The contractor may subcontract the fabrication, delivery, sale, or installation of one or more components of the crusher clearing system 100, 1000 or of other devices used to provide such one or more components. The contractor may also survey a site and design or designate one or more storage areas for stacking the material used to manufacture the systems discussed herein. The contractor may also maintain, modify, or upgrade the provided crushers, clearing systems, and components thereof. The contractor may provide such maintenance or modifications by subcontracting such services or by directly providing those services or components needed for said maintenance or modifications. In some cases, the contractor may modify an existing crusher with a "crusher clearing system retrofit kit" to arrive at a modified crushing process, modified crushing system, or modified crusher clearing system having one or more of the process steps, devices, components, or features of the systems discussed herein.

Although the invention has been described in terms of particular embodiments and applications, one of ordinary skill in the art, in light of this teaching, can generate additional embodiments and modifications without departing from the spirit of or exceeding the scope of the claimed invention. For example, while not shown, dual-acting cylinders 70, 1070, 1170 described herein may be inverted such that first 10, 1010 and second 20, 1020 securing members of the piston rod 30, 1030 capture the mounting portion 302 of the main frame 300 and the bodies of the cylinders are mounted to the mounting portion 102 of the alignment ring 200. In such instances, a crushing equilibrium state would be maintained with a pushing force on the piston 39, 1039, rather than a pulling force as shown, and tramp release would be facilitated by a pulling force on the piston relative to the cylinder body 82, 1082.

Accordingly, it is to be understood that the drawings and descriptions herein are proffered by way of example to facilitate comprehension of the invention and should not be construed to limit the scope thereof.

| Reference numeral identifiers | |
|---|---|
| 1 | Crusher |
| 10 | First securing member |
| 12 | Locking member |
| 14 | Piston rod nut |
| 15 | Shield |
| 16 | Centering washer (e.g., spherical, conical) |
| 17 | Fastener/connector |
| 18 | Centering cup (e.g., spherical, conical) |
| 20 | Second securing member |
| 22 | Collar |
| 24 | Outer seal |
| 26 | Inner seal |
| 30 | Piston rod |
| 31 | Locking recess |

-continued

| Reference numeral identifiers | |
|---|---|
| 32 | Collar mount |
| 33 | First securing member mount |
| 34 | Threaded interface |
| 35 | Thread |
| 36 | Distal end |
| 38 | Proximal end |
| 39 | Piston |
| 40 | Cylinder mount |
| 41 | Mounting flange |
| 42 | Centering cup (e.g., spherical, conical) |
| 43 | Lip |
| 44 | Support |
| 45 | Thread |
| 46 | Fastener |
| 47 | Lower bearing surface |
| 48 | Threaded centering bushing (e.g., spherical, conical) |
| 49 | Upper bearing surface |
| 50 | Cap |
| 52 | Threaded boss |
| 54 | First end plate |
| 56 | Fastener/connector |
| 58 | Thread |
| 60 | Seal |
| 62 | O-ring |
| 64 | O-ring |
| 66 | O-ring |
| 70 | Dual acting cylinder |
| 80 | Second end plate |
| 82 | Cylinder wall |
| 84 | Upper (first) chamber |
| 85 | Upper (first) crossover port |
| 86 | Lower (second) chamber |
| 87 | Crossover tube |
| 88 | Lower (second) crossover port |
| 90 | Relief valve |
| 92 | First port |
| 94 | T-junction |
| 95 | Transfer tube |
| 96 | Second port |
| 98 | Lower (second) chamber feed channel |
| 100, 1000 | Clearing system |
| 200, 1200 | Adjustment ring (first member) |
| 202, 1202 | Mounting portion |
| 204, 1204 | Opening |
| 206, 1206 | Receiving portion |
| 208, 1208 | First mating surface |
| 210 | Adjusting surface |
| 300, 1300 | Main frame (second member) |
| 302, 1302 | Mounting portion |
| 304, 1304 | Opening |
| 306 | Receiving portion |
| 307 | Shaft receiving portion |
| 308, 1308 | Second mating surface |
| 310 | Main frame hub |
| 400 | Bowl |
| 402 | Bowl liner |
| 404 | Bowl liner crushing surface |
| 406 | Adjusting surface |
| 500 | Head |
| 502 | Mantle |
| 504 | Mantle crushing surface |
| 507 | Head bore |
| 509 | Head axis |
| 602 | Entrance material |
| 604 | Crushed material |
| 700 | Main shaft |
| 709 | Main shaft axis |
| 800 | Drive shaft |
| 802 | Gear or transmission member |
| 900 | Eccentric |
| 902 | Gear or transmission member |
| 907 | Eccentric bore |
| 1010 | First securing member |
| 1014 | Piston rod nut |
| 1015 | Shield |
| 1018 | Centering cup (e.g., spherical, conical) |
| 1020 | Second securing member |
| 1022 | Collar |

-continued

| Reference numeral identifiers | |
|---|---|
| 1024 | Seal |
| 1030 | Piston rod |
| 1031 | Locking recess |
| 1032 | Collar mount |
| 1035 | Thread |
| 1039 | Piston |
| 1040 | Cylinder mount |
| 1041 | Mounting flange |
| 1042 | Centering portion (e.g., spherical, conical) |
| 1043 | Lip |
| 1044 | Support |
| 1048 | Threaded centering bushing (e.g., spherical, conical) |
| 1050 | Cap |
| 1052 | Threaded boss |
| 1054 | Endplate |
| 1056 | Fastener/connector |
| 1070 | Dual acting cylinder |
| 1082 | Cylinder wall |
| 1084 | Upper (first) chamber |
| 1086 | Lower (second) chamber |
| 1120 | Second securing member |
| 1122 | Threaded collar |
| 1130 | Piston rod |
| 1131 | Male thread |
| 1132 | Collar mount |
| 1134 | Smaller diameter distal portion |
| 1136 | Larger diameter proximal portion |
| 1170 | Dual-acting cylinder |

What is claimed is:

1. A crusher comprising:

a first member having a first mounting portion, a second member having a second mounting portion, a dual-acting cylinder having a body and a piston rod movably disposed in relation to said body, the body being securely mounted to the second mounting portion of the second member by a cylinder mount, wherein the piston rod further comprises a first securing member and a second securing member, wherein the first mounting portion of the first member is captured between said first securing member and second securing member to secure the piston rod thereto, and wherein the dual-acting cylinder provides both:

a crushing force between said first member and said second member, and a clearing force between said first member and said second member.

2. The crusher according to claim 1, wherein the first member comprises at least one of an alignment ring, a bowl, or a bowl liner and wherein the second member comprises a main frame of the crusher.

3. The crusher according to claim 1, wherein the crushing force between said first member and said second member is applied during a pull stroke of said piston rod, and the clearing force between said first member and said second member is applied during a push stroke of said piston rod.

4. The crusher according to claim 1, wherein one or more of said first and second securing members are integral with said piston rod.

5. The crusher according to claim 1, wherein the mount comprises a threaded interface between the dual-acting cylinder and the second mounting portion.

6. The crusher according to claim 1, wherein said dual-acting cylinder further comprises a relief valve.

7. The crusher according to claim 1, wherein said dual acting cylinder further comprises a first crossover port extending from a first chamber, a second crossover port extending from a second chamber, and a crossover tube extending between the first crossover port and the second crossover port and connecting the first chamber and the second chamber.

8. The crusher according to claim 1, wherein said first or second securing member further comprises a shield or seal configured to prevent the ingress of dirt, liquid, or dust.

9. The crusher according to claim 1, wherein said first securing member comprises a piston rod nut.

10. The crusher according to claim 1, wherein said second securing member comprises an annular collar which may be provided as: separate connectable pieces, a single separate piece connectable to the piston rod, or an integral portion of the piston rod.

11. The crusher according to claim 1, wherein one or more of said first and second securing members are separately joined, non-integral portions of said piston rod.

12. The crusher according to claim 1, wherein the piston rod comprises at least one mount for supporting at least one of said first and second securing members.

13. The crusher according to claim 1, wherein at least one of said first securing member, second securing member, and mount comprise one or more of the following: a centering washer, a centering cup, a centering portion, a centering bearing surface, or a centering feature.

14. The crusher according to claim 13, wherein said centering washer, centering cup, centering portion, centering bearing surface, and centering feature comprise a tapered, conical, or spherical surface.

15. A crusher clearing system adapted for providing crushing forces to components of a crusher and clearing forces to components of the crusher to facilitate the removal of tramp material from the crusher, the crusher clearing system comprising:

a dual-acting cylinder having a body and a piston rod movably disposed in relation to said body, the piston rod further comprising a first securing member adjacent a distal portion of the piston rod and a second securing member adjacent a proximal portion of the piston rod, wherein the first and second securing members are configured to capture a mounting portion of an adjustment ring therebetween;

wherein the first securing member is configured to seat against an upper surface of said mounting portion and apply a crushing force to the adjustment ring; and the second securing member is configured to seat against a lower surface of said mounting portion and apply a clearing force to the adjustment ring; and wherein the body of the cylinder is configured to be securely mounted to a second mounting portion of a second member by a cylinder mount.

16. A method of clearing a crusher including the steps of:

providing a crusher comprising: a first member having a first mounting portion; a second member having a second mounting portion; a dual-acting cylinder having a body and a piston rod movably disposed in relation to said body, the body being securely mounted to the second mounting portion of the second member by a cylinder mount; wherein the piston rod further comprises a first securing member and a second securing member; wherein the first mounting portion of the first member is captured between said first securing member and second securing member to secure the piston rod thereto;

filling a first chamber of the dual-acting cylinder to provide a crushing force between said first member and said second member; and filling a second chamber of the dual-acting cylinder to provide a clearing force between said first member and said second member.

17. The method of claim 16 further comprising the step of passing a fluid directly from the first chamber to the second chamber via a crossover tube extending between a first crossover port communicating with the first chamber and a second crossover port communicating with the second chamber, in order to prevent mechanical overload of the crusher.

18. The method of claim 16 further comprising the step of passing a fluid through a relief valve separating the first and second chambers, in order to prevent mechanical overload of the crusher.

* * * * *